US006604676B2

(12) United States Patent
Giblin

(10) Patent No.: US 6,604,676 B2
(45) **Date of Patent: *Aug. 12, 2003**

(54) LIP-LOCK CARTON FOR POWDERS

(75) Inventor: Edward John Giblin, Hopatcong, NJ (US)

(73) Assignee: Unilever Home & Personal Care USA, division of Conopco, Inc., Greenwich, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/474,159

(22) Filed: Dec. 29, 1999

(65) Prior Publication Data

US 2002/0074389 A1 Jun. 20, 2002

(51) Int. Cl.[7] ..... B65D 5/02
(52) U.S. Cl. ..... 229/225; 229/122.32; 229/148
(58) Field of Search ..... 229/122.32, 122.33, 229/148, 149, 223, 224, 225

(56) References Cited

U.S. PATENT DOCUMENTS

| | | | | | |
|---|---|---|---|---|---|
| 4,083,455 | A | * | 4/1978 | Keating, Jr. | 229/224 |
| 4,099,665 | A | * | 7/1978 | Bergstein | 229/149 |
| 4,252,267 | A | * | 2/1981 | Osborne | 229/149 |
| 4,865,203 | A | * | 9/1989 | Ueda | 229/225 |
| 5,161,734 | A | * | 11/1992 | Ruehl et al. | 229/223 |
| 5,265,799 | A | * | 11/1993 | Stone | 229/122.33 |
| 5,307,987 | A | | 5/1994 | Roccaforte | |
| 5,373,960 | A | * | 12/1994 | Gunn et al. | 229/225 |
| 5,505,374 | A | | 4/1996 | Stone | |
| 5,511,722 | A | * | 4/1996 | Dixon | 229/149 |
| 5,515,996 | A | * | 5/1996 | Stone | 229/122.32 |
| 5,775,576 | A | * | 7/1998 | Stone | 229/122.33 |
| 5,788,102 | A | * | 8/1998 | Hall et al. | 229/148 |
| 5,875,963 | A | * | 3/1999 | Stone et al. | 229/225 |

FOREIGN PATENT DOCUMENTS

| | | | | |
|---|---|---|---|---|
| EP | 0 454 506 | | 10/1991 | |
| EP | 0 443 930 | | 6/1993 | |
| FR | 2662141 | A1 * | 11/1991 | 229/148 |

* cited by examiner

*Primary Examiner*—Gary E. Elkins
(74) *Attorney, Agent, or Firm*—Gerard J. McGowan, Jr.

(57) ABSTRACT

A carton having a lid lock comprising a lip or flap extending from a liner and a debossment, embossment or opening in a panel forming the cover. The debossment, embossment or opening receives and/or limits the motion of the lip to lock closed the cover.

14 Claims, 4 Drawing Sheets

LIP-LOCK CARTON FOR POWDERS

BACKGROUND OF THE INVENTION

A decade or so ago, powdered detergent products of increased density began to appear on the market. Accompanying such products were packages which were quite different from those generally used for powdered detergents. The new packages typically included upper closure flaps which together with portions of the front and two side panels formed a recloseable lid for the container once the container was opened, as by separating a line of weakness extending through the first side panel, the front panel and the second side panel.

A problem attendant to the new concentrated detergent powder containers was the difficulty in keeping the lid closed once it had been opened. Various locking mechanisms have been proposed in, e.g., Gunn et al., U.S. Pat. No. 5,373,960, Stone, U.S. Pat. No. 5,515,996, Stone, U.S. Pat. No. 5,505,374, Ruehl, U.S. Pat. No. 5,161,734, and Roccaforte, U.S. Pat. No. 5,307,987.

SUMMARY OF THE INVENTION

The present invention is directed to a new solution to the problem of keeping reclosed detergent cartons locked. In accordance with the present invention, the detergent carton includes a liner having a lip or flap on one or more walls of the liner. Typically, the lip or flap will extend from the top wall. The lip is received within, or held by, an opening, debossment or embossment in one or more of the front or side panels of the carton to relock the cover of the carton after it has been initially opened. Typically, the flap-receiving opening, debossment or embossment will be present either on the front panel or on the first and second side panels. Generally, the lip or flap will be present extending from an upper end of the front wall or from the first and second side wall of a three- or more wall liner.

The present invention is more sparing of resources than some of the other proposed solutions to carton relocking. Consequently, it is a lower cost alternative. The ability to keep the lid or cover closed in between uses not only reduces the chance of powder spillage, but also improves moisture barrier effects to thereby retard powder lumping. Since an opening will decrease moisture barrier properties, a debossment or an embossment is preferred herein.

The liner is preferably a 3¼ sided liner which is adhered to the inner front, side and/or rear panels of the carton. The flap-receiving opening may be a longitudinally extending slit and the flap or lip may correspondingly extend longitudinally across the upper end, or much of the upper end, of the liner wall. Alternatively, the feature on the carton panel which corresponds to the flap or lip and which locks it into place is a debossment or embossment which may be in the shape of e.g., a ridge, again corresponding to the edge of the flap or lip.

The debossed ridge may be provided with a series of horizontal or vertical perforations and provides an interference or stop with the front edge or side edges of the liner lip(s). The liner can be manufactured in a nesting pattern so that the lip material is taken from the bottom of the liner, resulting in no need for additional paperboard.

Generally, the lip or flap will be folded downwardly so as best to interfere with the opening or debossment on the carton panel. Preferably the debossment, embossment or opening is positioned so that it is always below the bottom edge of the lip when the lid is closed. If desired, a series of horizontal or vertical perforations may be provided to the debossment or opening to enhance the interference or stoppage and to hold the lip in the closed position.

By "embossment" herein is meant a raising of the surface of the relevant structure. It does not refer to extensions, e.g., additional flaps or lips appended to a structure.

For a more complete understanding of the above and other features and advantages of the invention, reference should be made to the following description of the preferred embodiments.

DETAILED DESCRIPTION OF THE INVENTION

Figure 1:
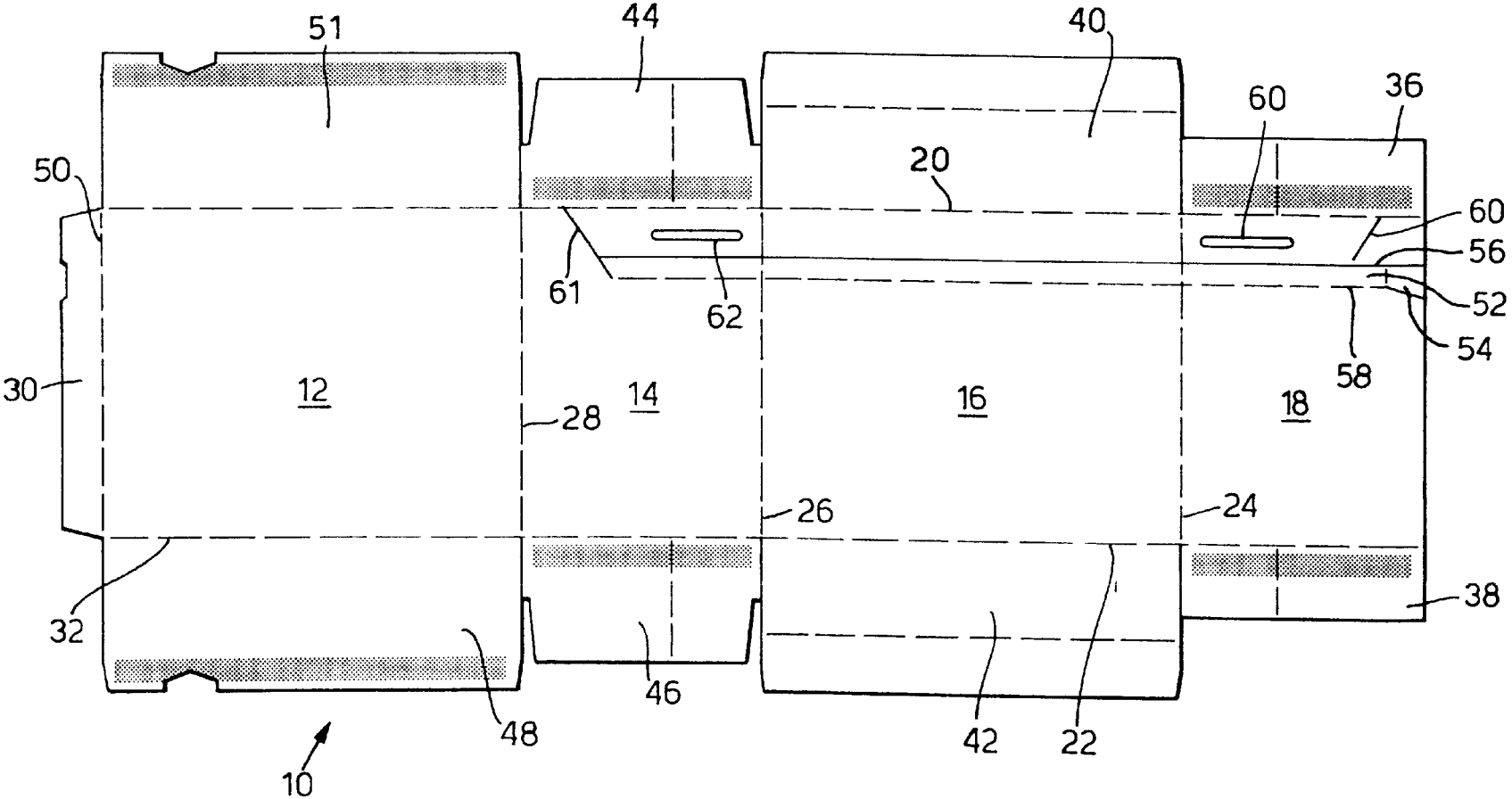
FIG. 1 is an outer plan view of a carton blank according to the invention.

Carton blank 10 (FIG. 1) includes side panel 18, front panel 16, side panel 14, rear panel 12 and glue flap 30 separated respectively by scorelines 24, 26, 28 and 50. Top scoreline 20 separates panels 18, 16, 14, and 12 from top flaps 36, 40, 44 and 50. Bottom scoreline 22 separates panels 18, 16, 14 and 12 from the bottom panels 38, 42, 46 and 48.

Tab 54 extends from one end of carton opener 52, which comprises parallel lines of weakness 56, 58 extending through panels 18, 16 and part of panel 14. At the opposite end of carton opener 52, diagonal line of weakness 62 extends to scoreline 20. At the other end of carton former 52, prior to reaching tab 54, diagonal line of weakness 60 extends between the upper edge of carton former 52 and upper scoreline 20.

Between upper line of weakness 56 of carton former 52 and upper scoreline 20 are disposed on panel 18 and 14 debossments 60, 62. These debossments are situated so as to lock or at least substantially lock into place lips on a carton liner, as will be seen below. Alternatively, an embossment or an opening may be used. The embossment limits movement of the lip and so similarly tends to lock the carton closed.

Carton blank 70 (FIG. 2) is similar to blank 10 except that a single embossment 80 is disposed in the front panel 16' above upper line of weakness 56' of carton opener 52' rather than the previous arrangement wherein separate debossments were disposed on panels 18 and 14. Debossment 60 is ridge-shaped and is disposed between upper line of weakness 56' and upper scoreline 20'.

Figure 3:
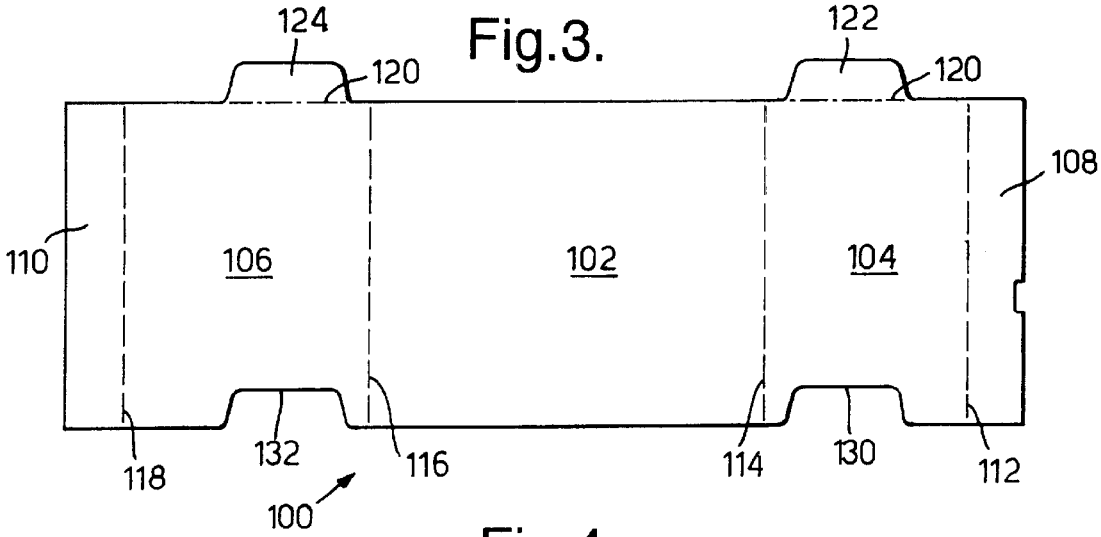
FIG. 3 is a top plan view of a carton liner according to one aspect of the invention.

Carton blank 100 (FIG. 3) comprises a center wall 102 and sidewalls 104, 106, in addition to rear flaps 108, 110. Flaps and walls 108, 104, 102, 106 and 110, respectfully, are separated by vertically extending scorelines 112, 114, 116 and 118.

Separated from side walls 104, 106 by scoreline 120 are lips or flaps 122, 124. Lips 122, 124 are formed during construction of the liner from the blank for the liner immediately above. That is, the liners are in this respect nested. Similarly, openings 130, 132 appear in liner 100 and these result from the cutting away of the lips for the liner immediately below the liner 100 when the liners are formed from a large piece of paperboard.

Figure 4:
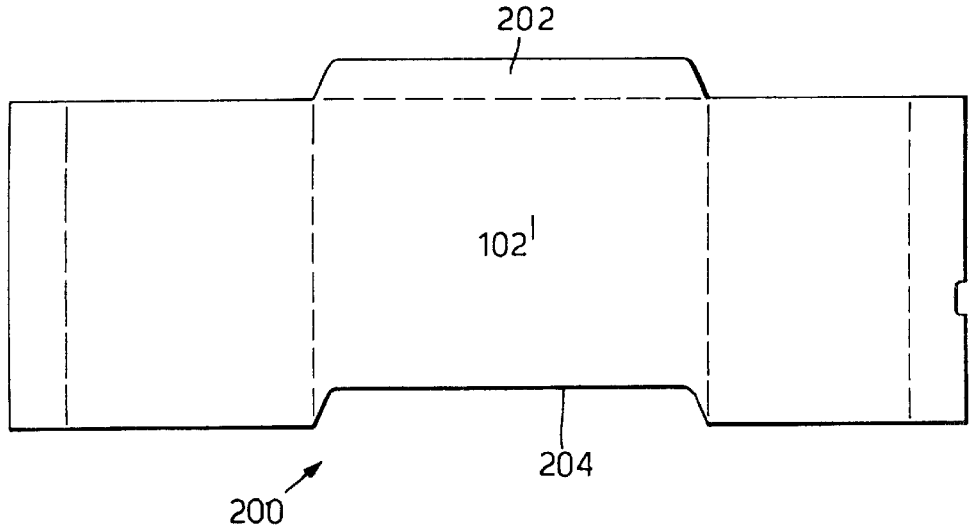
FIG. 4 is a top plan view of a carton liner according to an alternative aspect of the invention.

Liner 200 of FIG. 4 is similar to liner 100 except that it includes a single lip 202 and single opening 204 at the bottom of central wall 102' instead of the lips and openings associated with the side panels. It will be apparent that liner 100 would be used in conjunction with carton blank 10 whereas liner 200 would be used in conjunction with carton blank 70.

Figure 5:
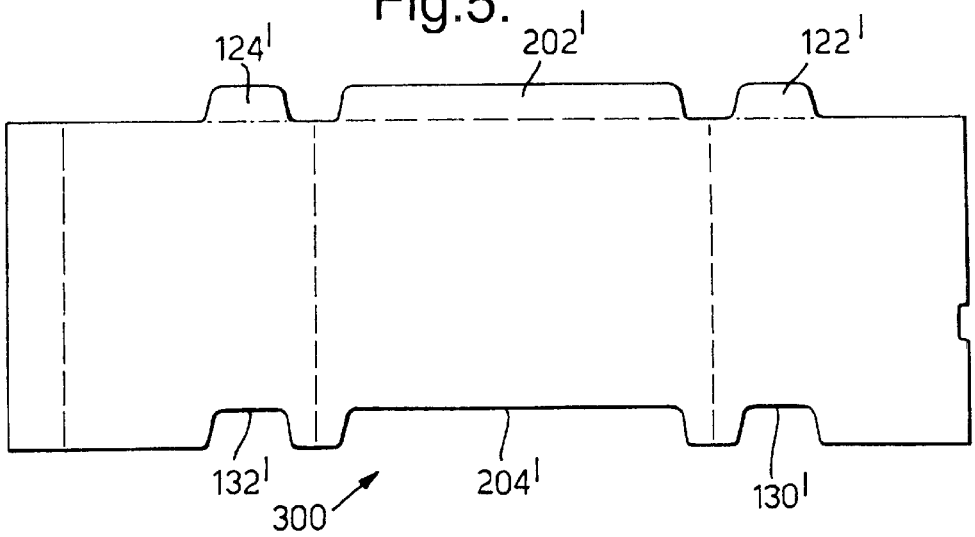
FIG. 5 is a top plan view of a liner according to a still further alternative aspect of the invention.
Figure 6:
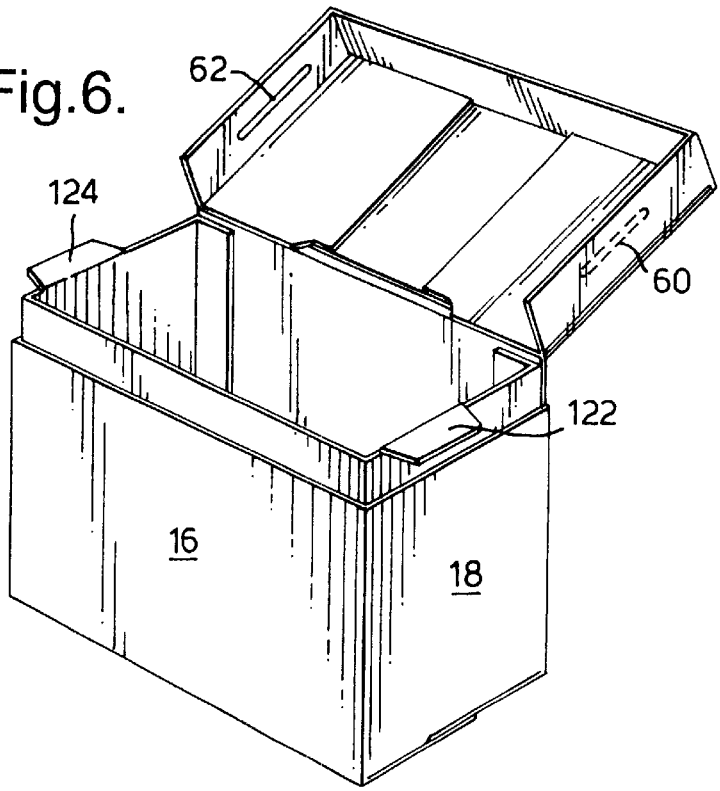
FIG. 6 is a perspective view of an erected carton according to the invention.
Figure 7:
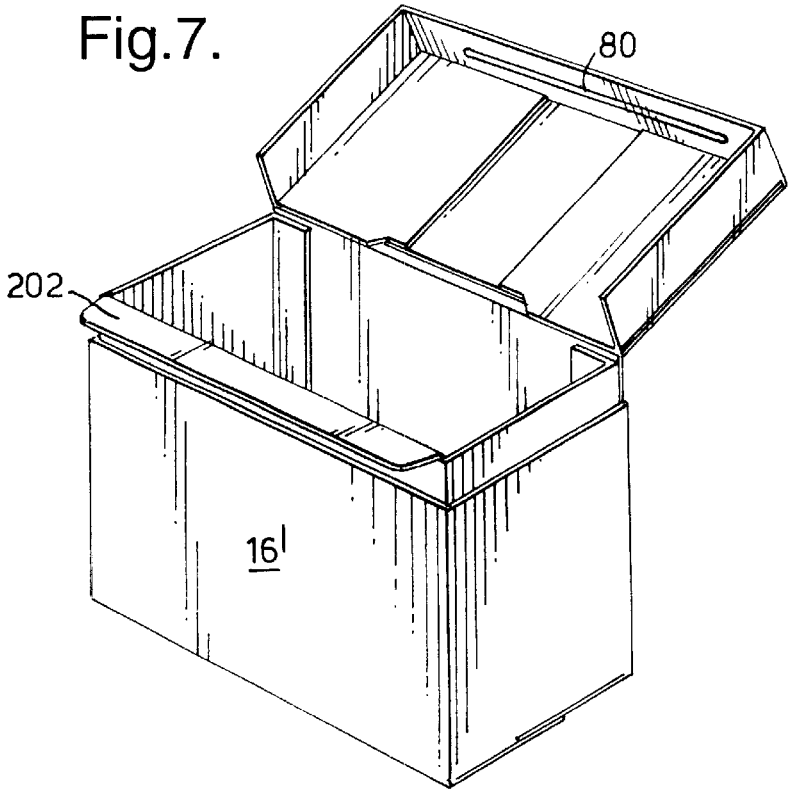
FIG. 7 is a perspective view of an alternative embodiment of the erected carton of the invention.

Liner 300 is similar to liners 200 and 100, except that it includes both lips 122', 202' and 124' and openings 130', 132' and 204'. It will be apparent that the liner of FIG. 5 may be used in conjunction with a carton which includes debossments or flap receiving openings in all three panels, namely the front panel and the two side panels.

The package of the invention is prepared by squaring the carton, adhering the glue flap to the inside of a side panel, folding and adhering the bottom closure flaps, squaring and inserting the liner and adhering the liner wall(s) to one or more inner sides of the panels of the cartons. The top closure panels are then folded and adhered to each other.

Figure 2:
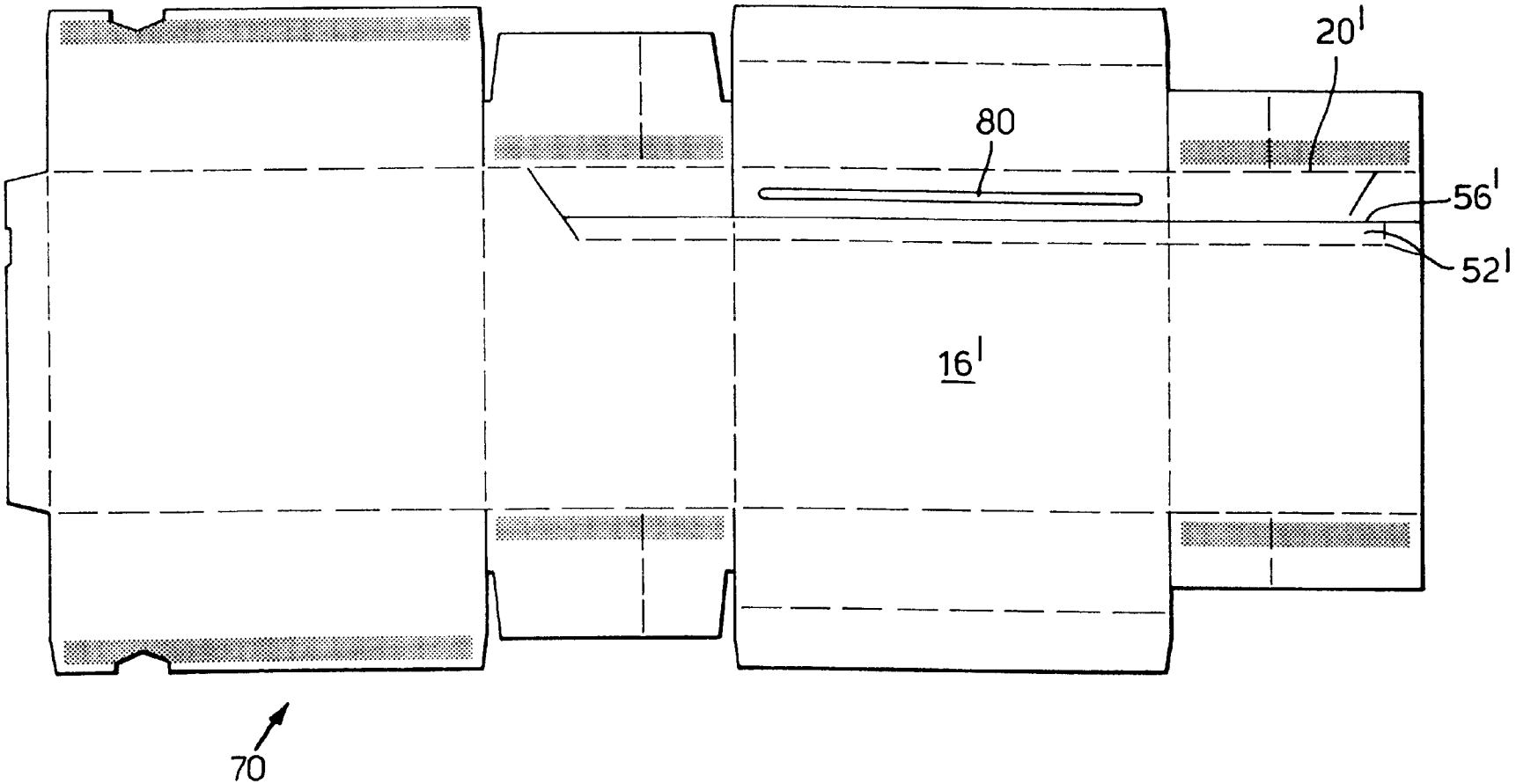
FIG. 2 is an outer plan view of an alternative carton blank according to the invention.

When it is desired for the consumer to open the container, referring particularly to FIGS. 1 and 2, he or she grasps tabs 54 and pulls it through panels 18, 16 and 14. This permits the combined top closure to be opened and then lifted upwardly. When some product has been removed and it is desired to store or transport the package for later use, the combined closure can be turned downwardly over the open container. This causes flaps 122, 124 to meet with debossments 60, 62. As a result, the closure is kept on the container, whereby a certain amount of force is required to remove the closure once again. This improves the moisture barrier properties of the container in that evaporation from the product is impeded. Also, product sifting outside of the container is impeded as well.

Although the invention is described as including a debossment or embossment for receiving the flap or lip, an opening such as a slot or slit may be used instead. The carton and liner may be made, independently, of paperboard, plastic or other suitable materials.

It should be understood of course that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A carton comprising a front panel, a first side panel adjacent thereto, a rear panel opposite the front panel and a second side panel between the front and rear panels and opposite the first side panel, top closure flaps, bottom closure flaps, a carton opener extending through at least portions of at least three of the panels, and a flap receiving debossment or embossment in at least one of the panels through with the carton opener extends and above the carton opener.

2. The carton according to claim 1 wherein the flap receiving debossment or embossment is present in the front panel.

3. The carton according to claim 1 wherein the flap receiving debossment or embossment is present in one or more of the first and second side panels.

4. The carton according to claim 3 wherein the flap receiving debossment or embossment is present in both the first and second side panels.

5. The carton of claim 1 wherein said carton opener comprises parallel lines of weakness in said panels.

6. A carton comprising a front panel, a first side panel adjacent thereto, a rear panel opposite the front panel and a second side panel between the front and rear panels and opposite the first side panel, top closure flaps, bottom closure flaps, a carton opener extending through at least three of the panels, and a flap receiving debossment or embossment in at least one of the panels through which the carton opener extends and above the carton opener, a liner comprising at least one liner wall and having at least one re-locking flap extending from the wall, the flap being positioned to insert into the flap receiving debossment or embossment when the carton is re-closed after the carton opener has been removed.

7. The carton according to claim 6 wherein the flap receiving debossment or embossment is present in the front panel.

8. The carton according to claim 6 wherein the flap receiving debossment or embossment is present in one or more of the first and second side panels.

9. The carton according to claim 8 wherein the liner includes at least three walls and the flap receiving debossment or embossment is present in both of the first and second side panels.

10. The carton according to claim 9 wherein the re-locking flap extends from an upper end of the liner wall.

11. The carton according to claim 6 wherein the liner includes at least three walls.

12. The carton of claim 6 wherein said carton opener comprises parallel lines of weakness in said panels.

13. A carton blank comprising a front panel, first and second side panels on opposite sides of the front panel, a rear panel on a side of one of the first and second side panels opposite the front panel, at least three of the panels including one or more top closure flaps at an upper end of the panels, a carton opener extending through portions of at least the first and second side panel and the front panel, and a flap receiving embossment or debossment above the carton opener in at least one of the panels through with the carton opener extends, the debossment or embossment being disposed between the carton opener and the upper ends of the panels.

14. The carton blank of claim 13 wherein said carton opener comprises parallel lines of weakness in said panels.

* * * * *